United States Patent [19]

Micallef

[11] 4,157,774

[45] Jun. 12, 1979

[54] DISPENSING PUMP WITH TRIGGER ACTUATOR

[75] Inventor: Lewis A. Micallef, Fort Lee, N.J.

[73] Assignee: Leeds and Micallef, Fort Lee, N.J.

[21] Appl. No.: 621,280

[22] Filed: Oct. 10, 1975

[51] Int. Cl.[2] ..... B05B 9/043

[52] U.S. Cl. ..... 222/321; 222/402.15; 222/509

[58] Field of Search ..... 222/320, 321, 505, 509, 222/402.15; 239/333

[56] References Cited

U.S. PATENT DOCUMENTS

| | | | |
|---|---|---|---|
| 2,737,329 | 3/1956 | Bolsey | 222/321 X |
| 2,941,700 | 6/1960 | Gable | 222/402.15 |
| 3,174,659 | 3/1965 | Sorber et al. | 222/509 X |
| 3,314,577 | 4/1967 | Doblin | 222/402.15 X |
| 3,429,484 | 2/1969 | Baldwin | 222/509 X |
| 3,452,905 | 7/1969 | Micallef | 222/321 X |
| 3,478,935 | 11/1969 | Brooks | 222/321 |
| 3,987,942 | 10/1976 | Morane et al. | 222/402.15 |

FOREIGN PATENT DOCUMENTS

| | | | |
|---|---|---|---|
| 366626 | 2/1932 | United Kingdom | 222/402.15 |

*Primary Examiner*—Stanley H. Tollberg
*Assistant Examiner*—Frederick R. Handren
*Attorney, Agent, or Firm*—Kane, Dalsimer, Kane, Sullivan and Kurucz

[57] ABSTRACT

A reversible trigger actuated dispensing pump employs a reciprocal plunger having a passage for communication with a pump at one end and a nozzle at the other end. The trigger includes a body portion with structure to cooperate with the plunger to permit the trigger to be releasably and pivotally mounted on the plunger in at least two angularly spaced positions. An actuating gripping portion extends from the body portion and from the pump when the trigger is mounted thereon. In this manner, when the trigger is mounted on the plunger and the actuating gripping portion is pivoted, the body portion will pivot and reciprocate the plunger and operate the dispensing pump.

16 Claims, 8 Drawing Figures

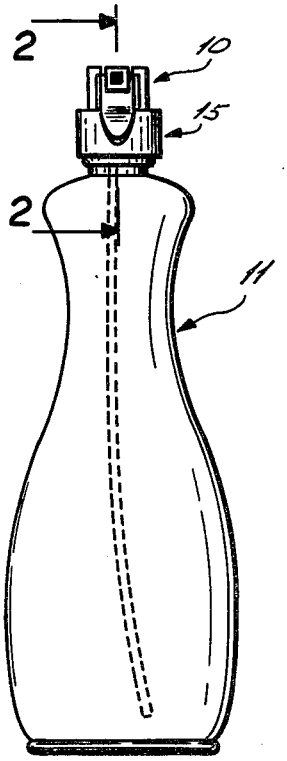
FIG. 1
FIG. 2
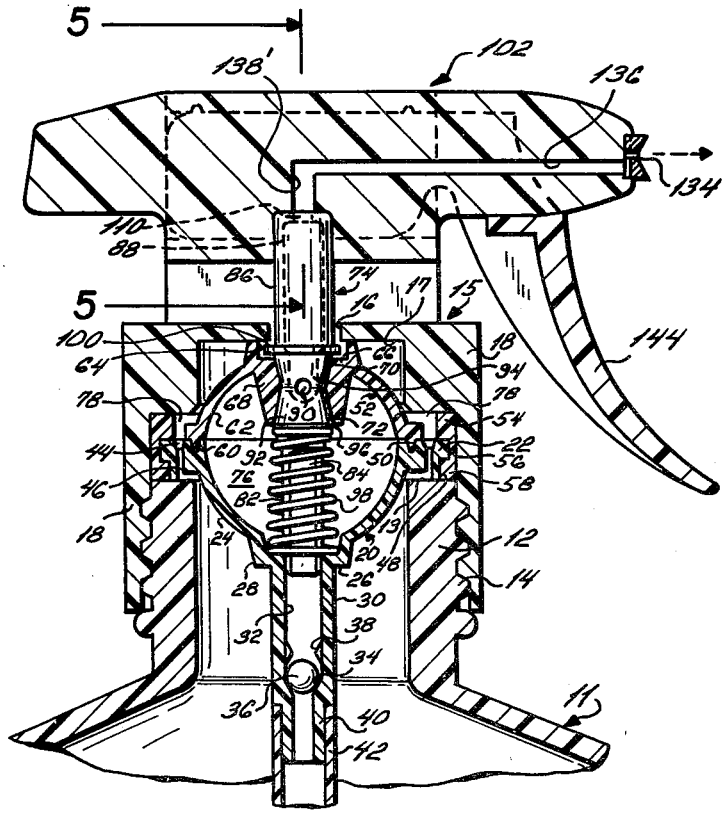

FIG. 4
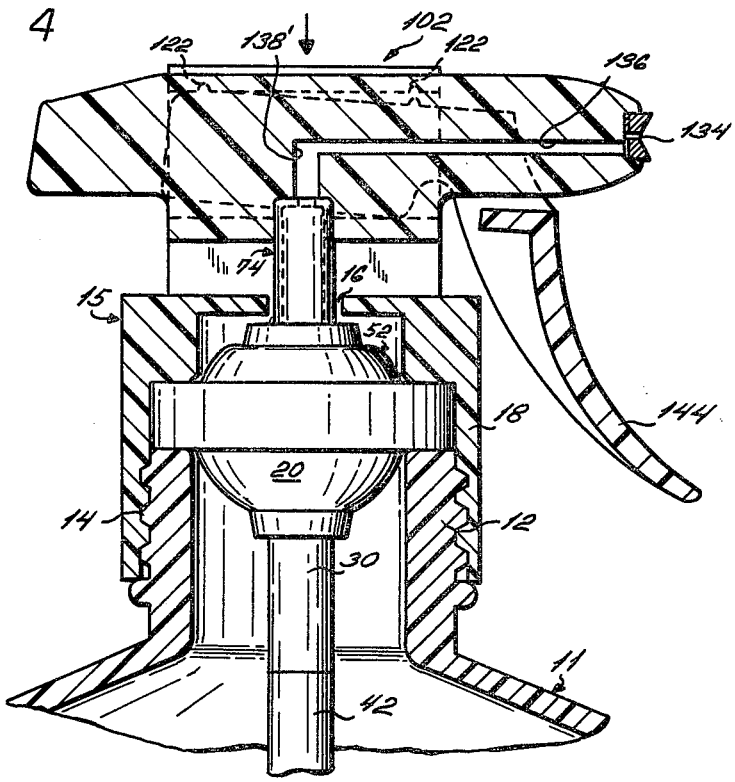
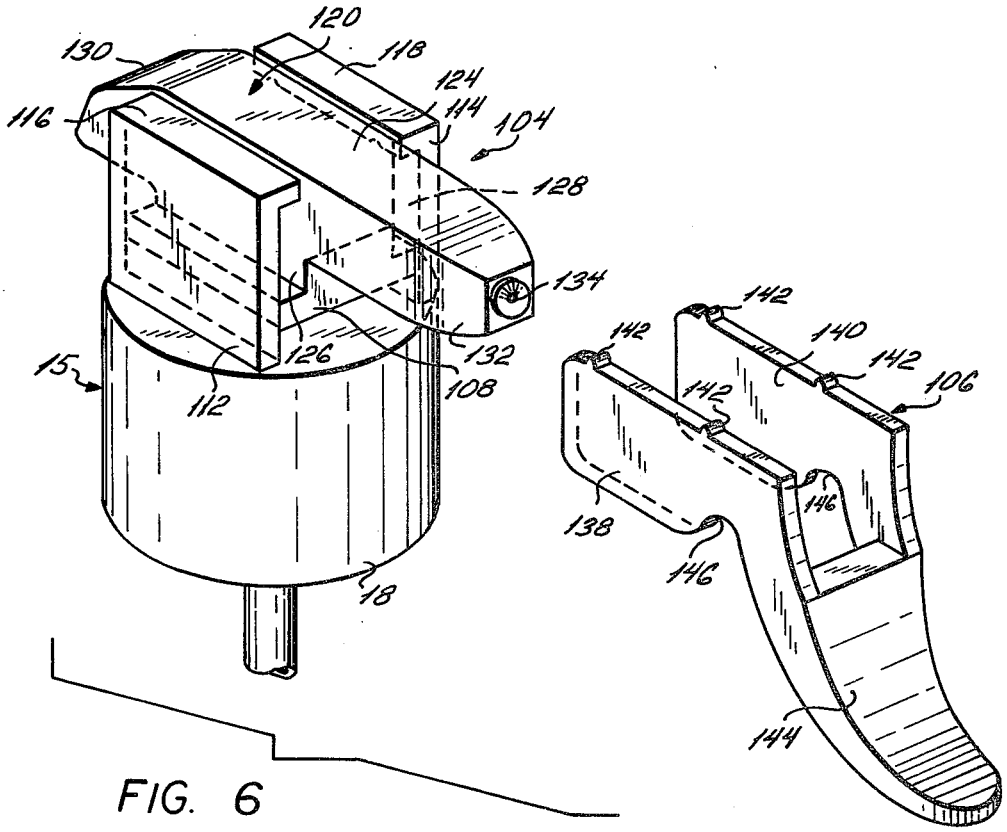
FIG. 6

DISPENSING PUMP WITH TRIGGER ACTUATOR

BACKGROUND OF THE INVENTION

There has always been an ever increasing need insofar as consumer products are concerned for pumps of better construction and superior as well as efficient performance but, most important of all, an urgent need presently exists for pumps having such characteristics but of significantly simple design and construction that are materially lower in cost of construction, manufacture and assembly and which are versatile in structure and use. An example of a pump of the type that satisfies this need is disclosed in U.S. Pat. No. 3,452,905.

Within the recent pasts and continuing on into the present, trigger actuated pumps are receiving wide market preference and appeal for handling and dispensing materials of a wide variety as those commonly marketed in the cosmetic, toiletry, food, agricultural and industrial products fields. The present invention relates to fluid dispensing pumps for containers that is adapted to be actuated by a trigger actuated mechanism and, more particularly, to trigger actuated reciprocal plunger-type pumps of which the foregoing patented pump is an example.

SUMMARY OF THE INVENTION

It is, accordingly, among the principal objectives of the present invention to provide a trigger actuated reciprocal dispensing pump which is leakproof in substantially all positions and conditions of storage, transit and use, yet performs and operates reliably and efficiently while being of simple construction and being relatively inexpensive to manufacture and assemble. Furthermore, the design construction is such that it can be used in more than one structural configuration due to the versatility and interchangeability of operating parts of the pump structure. In particular, a reversible trigger is provided which can be removed and remounted in several different positions for operation of the pump.

In summary, a reversible trigger actuated dispensing pump is provided which employs a reciprocal plunger having a through passage for communication with a pump at one end and a nozzle at the other end. The trigger includes a body portion with means on the body portion to cooperate with the plunger to permit the trigger to be releasably and pivotally mounted on the plunger in at least two angularly spaced positions. An actuating gripping portion extends from the body portion and from the pump when the trigger is mounted thereon so that when the trigger is mounted on the plunger and the actuating gripping portion is pivoted, the body portion will pivot and reciprocate the plunger and operate the dispensing pump.

Other objectives and advantages will become apparent from the following detailed description which is to be taken in conjunction with the accompanying drawings illustrating a somewhat preferred embodiment of the invention.

BRIEF DESCRIPTION OF THE DRAWINGS

In the drawings:

FIG. 1 is an elevational view of a cap container incorporating a trigger actuated reciprocal dispensing pump in accordance with the present invention;

FIG. 2 is an enlarged fragmentary longitudinal sectional view taken along the line 2—2 of FIG. 1 through the neck and cap of the container as well as the reciprocal dispensing pump showing the pump parts in a releasably locked fully extended retracted position;

FIG. 4 is again a similar view showing the pump during its retraction stroke at which liquid in the container is adapted to be forced up into the pump chamber and ambient air permitted to replace the liquid drawn upwardly from the container;

FIG. 6 is a perspective view of the pump with the trigger removed from the initial operable position;

DESCRIPTION OF THE PREFERRED EMBODIMENT

Figure 3:
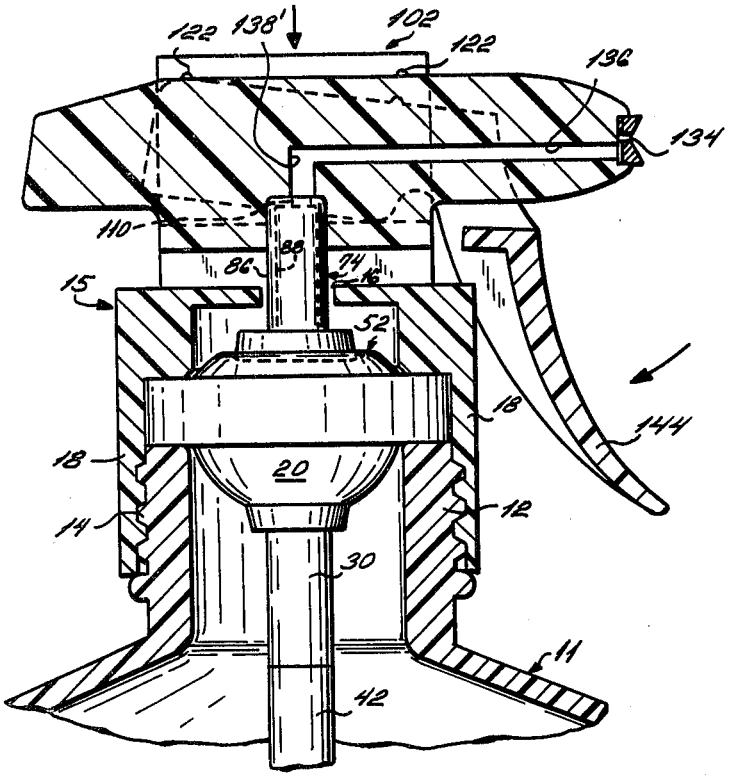
FIG. 3 is a similar view showing the pump position at the downward end of the pumping stroke during which liquid to be dispensed is forced out of the pump chamber through the discharge passageways.
Figure 5:
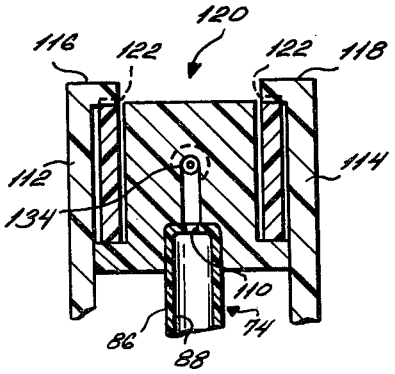
FIG. 5 is a sectional end view of the pump taken along line 2—2 of FIG. 2.

In the drawings, the reciprocal dispensing pump 10 of this invention is shown disposed across the opening of a container 11 which may assume the form of any conventional bottle or similar receptacle, made of glass, plastic or other suitable materials. The container may be used for holding and dispensing a wide variety of materials generally in liquid form as may be found on the market today. These liquids may possess different degrees of viscosities and may include oil, perfume or the like, or pasty substances such as creams or the like, or gaseous substances.

Container 11 includes a neck 12 terminating in an upper end 13 defining an opening into the container interior. Threads 14 on the exterior of the neck 12 conveniently support a cap 15 having a substantially coaxial opening 16 in top wall 17 which extends inwardly from the reduced substantially cylindrical skirt 18. Obviously, any other form of securing means between the cap 15 on the neck 12 may be employed either as a permanent or temporary nature.

Pump 10 is conveniently mounted across the opening defined by the neck 12 of the container by means of cap 15. Pump 10 includes a bottom substantially rigid wall defined by member 20 having a substantially circular peripheral flange 22 in a substantially dish-shaped body portion 24 inwardly thereof. The base of bottom member 20 includes a substantially flat base 26 extending inwardly of the substantially conical wall 28 which forms an extension of the dished body portion 24. A substantially cylindrical tube 30 extends downwardly and integrally from the base 26 which, together with the tube, defines a substantially coaxial bore 32 serving as a liquid passage. Tube 30 is provided with a valve seat 34 for defining a sealing zone along with a ball check valve 36. The interior of tube 30 may also be furnished with retaining elements as shown in U.S. Pat. No. 3,452,905 or, alternatively, may be furnished with a spring retained within tube 30 in fixed position. The spring would normally bias the ball check valve 36 against the valve seat 32 and suitable force would be required to unseat ball 36 to permit flow. Additionally, when the force is released the spring will assure positive seating of the ball against valve seat 34 to once again close the passageway. In this manner, long term priming and metering of the pump is obtained. The lower end of tube 30 is provided with a reduced boss 40 for receiving a conventional dip tube 42 for conducting liquid to be dispensed from the container interior.

The peripheral flange 22 of bottom member 20 is provided with a substantially circular air passage in the form of recess 44. This recess has extending therefrom passage 46 which communicates with the container interior and which as will become evident shortly, forms part of an air passage network for replenishing the container with air as the liquid therein is dispensed. Flange 22 is also provided with a circumferentially extending recess 48 and another substantially circular recess 50 for mating with surfaces of the flexible top member 52 for interconnecting the bottom member 20 and top flexible member 52 in a substantially sealed manner.

Reference is now made to the flexible top member 52 which operates as a pump diaphragm. Diaphragm 52 includes a peripherally extending flange 54 resting on flange 22 of bottom member 20 in a substantially liquid type manner while under the pressure exerted by the associated surfaces of the cap 15 the tightening of which serves to seal in a liquid tight manner the peripheral junction between the top member 52 and the bottom member 20 as well as the neck 12 of the container through the sealed interengagement between the bead 58 and top edge 13 of container 11. A depending skirt 56 extends downwardly from flange 54 and it terminates in an inwardly extending bead 58 which is conveniently received by the recess 48 for purposes of maintaining top member 52 and bottom member 20 associated and in an assembled condition following pump assembly and prior to placement across the opening in the neck of container 11. Of course, the association of bead 58 in the recess 48 cooperates in sealing the mating and associated surfaces of the top member 52 and bottom member 20. This seal is perfected and optimized as a result of the interengagement of surfaces of the downward projection 60 on the flange 54 and the recess 50 in the flange 22.

Diaphragm 52 further includes a flexible body portion 62 extending inwardly of the flange 54. An upstanding circular rib 64 is disposed interiorly of flexible portion 62 and operates to seal against the bottom face of the top 17 of cap 15 when the pump 10 is in a fully retracted position. A flat transverse shoulder 66 extends inwardly of the rib 64 and serves as a bearing surface against which pressure is applied to subject the pump to its pumping cycle for purposes of dispensing liquid. A downwardly depending enlarged boss 68 serving as a valve extends downwardly of the shoulder 66 interiorly of the flexible portion 52. The interior of the boss 68 includes a substantially inverted conical surface 70 joined with a conical surface 72 for association with the complimentary surfaces of a plunger generally designated by numeral 74 which together with the bottom substantially rigid member 20 and flexible diaphragm 52 defines a pump chamber 76. As part of the air passage network mentioned in the above, the flange 54 of diaphragm 52 is provided with one or more openings 78 which communicate with the circular recess 44 and the ambient atmosphere particularly when the pump is actuated through its pumping cycle and during its retraction cycle.

Reference is now made to the plunger 74 which cooperates in deflecting diaphragm 52 during the pumping cycle whereby the capacity of the pump chamber 76 is varied and also in providing passage of liquid during dispensing and filling of pump chamber 76. In this connection, the plunger 74 includes a lower end 82 provided with at least one flat section 84 which cooperates with the adjacent surfaces of the inner surfaces 32 of tube 30 in defining a liquid passage therebetween. Of course, the lower end of stem 82 serves to define the path of reciprocation of plunger 74 through its cooperation with the associated surfaces of tube 30. The upper end of plunger 74 includes a tubular portion 86 defining a bore 88 which is open at the upper end of the tubular portion 86 and terminates approximately midway between the ends of the plunger 74. The inner end of bore 88 communicates with radial or transverse holes 90 which, during the pumping stroke, communicates with the liquid pump chamber 76. Opening 90 is adapted to be closed or sealed by opposed surfaces of boss 68 of diaphragm 52 during the retraction of the plunger while, on the other hand, this valving arrangement is adapted to be opened under the influence of the internal liquid pressure built up in the pump chamber 76 as a result of the downward stroke of the plunger 74. Toward this end, the central section of the plunger 74 is provided with a conical portion 92 and an inverted conical portion 94 both of which are complimentary with the conical surfaces 70 and 72 of bore 68 of diaphragm 52. The base of the conical portion 92 defines a shoulder 96 with the lower end of the plunger. A spring 98 is disposed against the shoulder 96 as well as the flat face 26 of base member 20; and in this manner, plunger 74 is biased upwardly whereby the spring will be compressed during the pumping stroke and the plunger will be urged toward its extended upward position during the retraction stroke. A radially extending rib 100 is disposed between the upper conical portion 94 and tubular end 86 of plunger 74 for engaging with shoulder 66 of the central enlarged boss 68 of the diaphragm 52 during the pumping stroke to thereby assure downward deflection of diaphragm 52 as the plunger is shifted downwardly. Radial rib 100 is also adapted to serve as a stop by engaging wall 17 to thereby limit the extent of retraction of plunger 74. Ordinarily rib 100 will be disposed as shown in FIG. 2 prior to actuation of the pump.

In order to facilitate depression of plunger 74 and to direct the liquid to be dispensed in the desired direction and with the desired dispensing pattern, a plunger actuator and trigger assembly 102 is advantageously fixed to the upper end 86 of plunger 74. Assembly 102 includes a plunger head portion and nozzle 104 and reversible trigger 106. Head portion 104 includes a rectangular base 108 associated with upper portion 86 as shown. An aperture 110 is provided for passage of fluid being dispensed. Aperture 110 communicates with bore 88 within plunger portion 74. Integral or affixed to opposing edges of base 108 are a pair of upstanding side walls 112 and 114 which are substantially rectangular in configuration and have their bottom edges resting on or affixed to the upper surface 17. Extending inwardly from the opposed substantially parallel vertical side walls at the top thereof are a pair of opposed flanges 116 and 118. The flanges are spaced apart to receive the nozzle housing 120. The undersurface of each flange 116 and 118 includes a pair of spaced notches 122 with the notches on each flange 116 and 118 being aligned.

Mounted on base 108 is the nozzle housing 120 which has a main body portion 124 which is rectangular in configuration and is positioned between the upstanding side walls 112 and 114 and spaced therefrom so as to form a pair of opposing channels 126 and 128 which are open at both ends. The rear end 130 of nozzle housing 120 extends partially laterally from the remainder of dispensing pump 10 and has a beveled upper surface to facilitate finger gripping for dispensing purposes. The opposite end of nozzle housing 120 is in the form of an elongated laterally extending nose 132 which terminates in a nozzle orifice 134. The nozzle orifice communicates internally with a laterally extended longer nozzle passage 136 which extends at right angles to a shorter leg 138' which is in communication with passageway 110 into the remainder of the plunger. This forms the passageway for fluid being dispensed. Nozzle 134 includes suitable break-up recesses to facilitate transmittal of a spray or other selected discharge pattern therefrom.

The removable reversible trigger mechanism 106 is designed to fit into channels 126 and 128 from either open end so that the dispensing mechanism can be operated by depressing the trigger toward the dispenser either on the side of the location of nose 132 or on the side of the location of rear end 130. In this manner, the trigger may be actuated by an individual's forefinger or thumb and be either opposed or on the same side as the nose 132. The configuration of trigger mechanism 106 facilitates its insertion, removal and use in operation of the dispensing pump. It includes a pair of opposed rectangularly shaped prongs 138 and 140 which are spaced and substantially parallel to each other. Each prong has a pair of spaced shoulders 142 extending from its upper surface, the pair of shoulders on each prong being substantially aligned with the pair of shoulders on the other prong and being tapered so as to form a linear apex or rounded as shown in the depicted embodiment. The recesses on the undersurface of flanges 116 and 118 are similarly formed so as to mate with shoulders 142 when the prongs are inserted in channels 126 and 128. The prongs are inserted until the shoulders snap into position due to the resilient nature of the material utilized for the trigger mechanism and the remainder of the dispensing pump. As stated above, this can be formed of a suitable plastic or other type of well known conventional resilient yet somewhat rigid material.

The length of prongs 138 and 140 is a matter of choice and is actuated to determine the length of stroke of the trigger mechanism 106 and accordingly the plunger assembly.

Integrally formed with prongs 138 and 140 is an arcuately shaped gripping actuator lever 144 which is curved down and away from the prongs so as to facilitate depression of the lever and actuation of the trigger mechanism when the pump is operated. Adjacent the point where the prongs 138 and 140 join with actuator 144 is an arcuate recess 146 which facilitate the camming and pivotal action of the trigger mechanism in operation.

Figure 7:
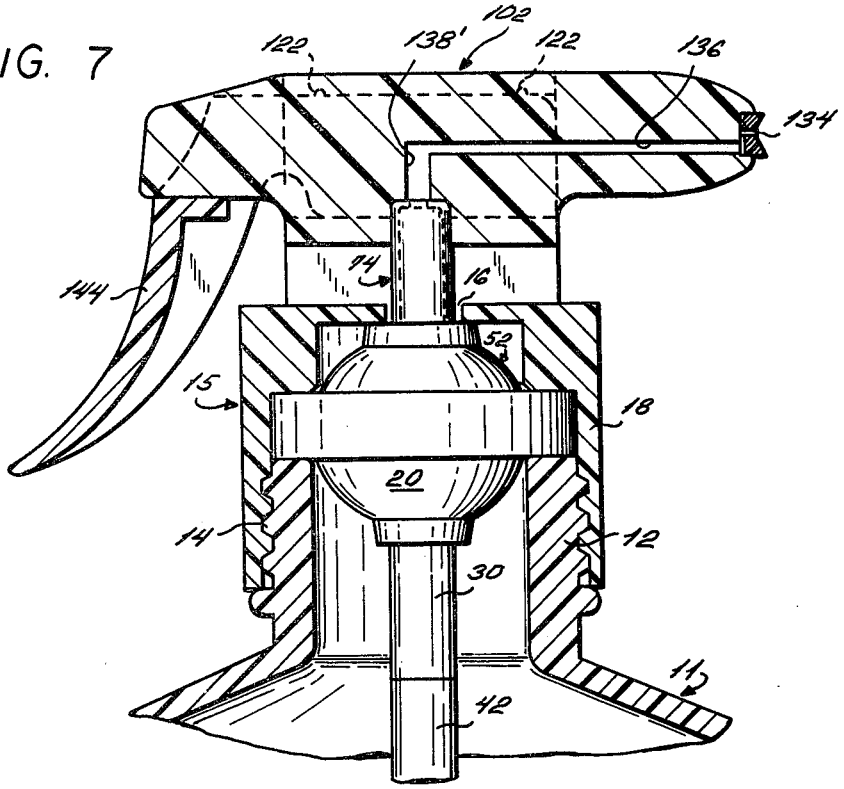
FIG. 7 is an enlarged fragmentary sectional elevation view of an alternate arrangement with the trigger shown in an alternate position and showing the pump parts in a releasably locked fully extended retracted position.
Figure 8:
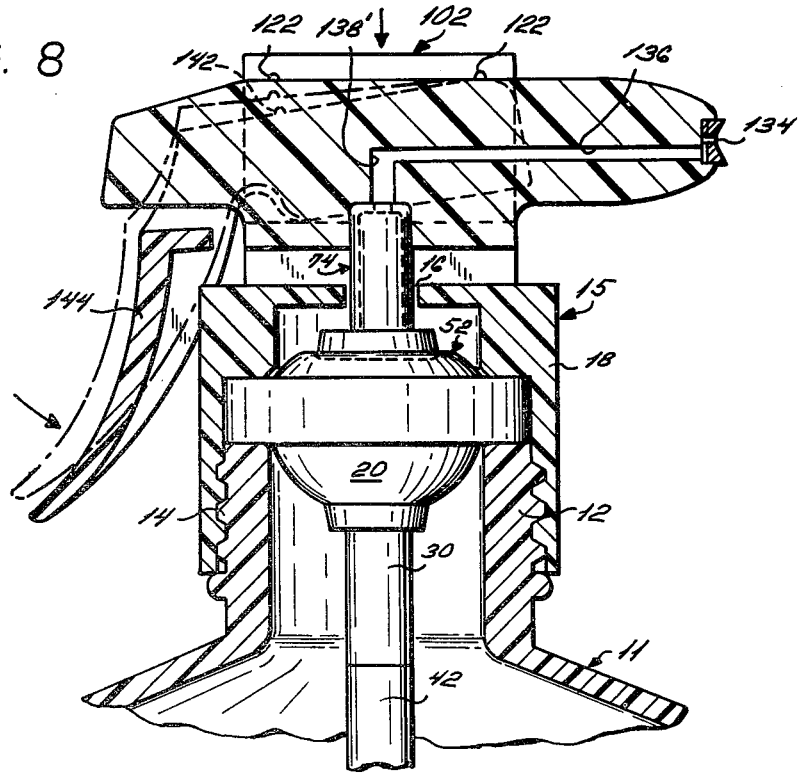
FIG. 8 is a further view of the pump and trigger location of FIG. 7 and showing the direction of movement of the dispensing trigger in phantom until pivoted to the fully open position with the liquid having been dispensed out of the pump chamber through the discharge passageways.

Prongs 138 and 140 are separated sufficiently so that they are aligned with channels 126 and 128 and receive nozzle housing 120 therebetween. When snapped into operable position in one direction, the assembly takes the configuration as depicted in FIGS. 2–5 and when removed and placed in operable position from the other direction, the assembly takes the configuration as depicted in FIGS. 7 and 8.

In operation and as shown in the sequence of FIGS. 2, 3 and 4 and FIGS. 7 and 8 in the other operable arrangement, depression of actuator lever 144 causes the undersurface of prongs 138 and 140 to depress base 108 which in turn depresses the remainder of plunger 74 actuating the pump and dispensing fluid in a manner as described in U.S. Pat. No. 3,452,905 and above. The reversible trigger 106 facilitates the operation of the dispensing pump in at least two different manners and other arrangements can be readily envisioned with the ability of the trigger mechanism 106 to be displaced from one position and reassembled at another operable position.

The passage of air through opening 16 and into the interior pump mechanism can be accomplished in a manner quite similar to that described in U.S. Pat. No. 3,452,905 and it should also be noted that passageways 16 are open to ambient air during operation of the pump and are not covered by a cap-like mechanism as in the above referenced patent. Accordingly, air can readily pass to and from the interior of the pump mechanism as it is operated. It should also be kept in mind that appropriate sealing means can be employed to prevent accidental operation of the pump during shipping and storage such as the type disclosed in U.S. Pat. No. 3,452,905.

The stroke of plunger 74 may be regulated by one of a number of conventional means; and, as shown in the illustrated embodiment, the end of the pumping stroke is controlled by the permissible compression of spring 98.

Of course, each of the conical surfaces 70 and 72 and their associated surfaces 94 and 92, respectively, may assume different angular relations relative to the access of the plunger 74 and may be of a shape other than conical as, for example, hyperbolic or parabolic. In this connection, the selected design should, as the illustrated embodiment, provide for a substantially liquid type seal closing the radial openings 90 and the plunger 74 during the rest or non-use position of the pump 10 and particularly during the retraction stroke of the plunger 74. Naturally, the seal should provide a substantially leakproof juncture at all ties between the diaphragm 52 and the plunger 74 while permitting during the pumping stroke the separation of the conical face 72 and the opposed conical face 92 to thereby permit passage therebetween of the liquid within the pump chamber 76 through the opening 90 and eventually out through the nozzle or opening 134.

The container 11, as previously stated, may be either metal, glass or plastic or similar material. The material of the base member 20, cap 15 and assembly 104 together with the plunger 74 is preferably selected from a wide range of rigid material such as metal, plastics, hard rubber or the like while retaining sufficient resiliency between the trigger mechanism 106 and the receiving surfaces of the plunger housing to permit snap-in and snap-out therebetween. The material of diaphragm 52 should preferably possess flexibility and may be selected from a wide range of natural or synthetic elastomeric material such as polyethylene, rubber, Buna, or any other flexible elastic material.

In operation, assuming for purposes of this description that the liquid to be dispensed is contained in the pump chamber 76, actuator lever 144 is manually depressed downwardly to initiate the pumping stroke.

This is true whether the trigger 106 is in either of the two positions depicted. If, on the other hand, liquid is not present in chamber 76, the following pumping cycle should be repeated until the pump is primed and liquid to be dispensed is present in chamber 76. During the pumping cycle, plunger 74 is forced downwardly. Rib 100 will engage the substantially flat face 66 of diaphragm 52 to cause the diaphragm to deflect downwardly. Substantially simultaneously therewith, the lower conical face 72 of bore 68 of diaphragm 52 will, under the influence of the internal pressure built up within the pump chamber 76, separate from the conical face 92 to permit access to openings 90.

As actuator lever 144 is depressed and plunger 74 is correspondingly depressed, the volume of the pump chamber 76 will be reduced to force the liquid therein under pressure out through openings 90 through bore 88 and through opening 110 into passageway 138' from where it will pass through lateral passageway 136 and out through nozzle 134. The maximum pumping stroke of plunger 74 is determined by the permissible compression of the spring 98. Upon release of actuator lever 144 and consequent retraction of plunger 74 under the influence of spring 98, pumping chamber 76 will start to expand thereby creating a suction which will draw liquid from the interior of container 11 up through the tube 42 through the bore of boss 40 pass the check valve 36 which will at this stage be forced to unseat. The liquid will be drawn through bore 32 into the pumping chamber 76. As the pumping chamber 76 is filled, the ambient air will flow through opening 16 and into the interior of the pump to replenish the volume of liquid drawn into the chamber 76. Spring 98 will eventually cause the annular lip 64 of diaphragm 52 to seat against the lower face of plate 17 whereupon diaphragm 52 will come to rest. The plunger 74 and assembly 104 will assume the position shown in FIG. 2 or FIG. 7 at which the pumping cycle may be repeated. During the retraction of the plunger 74 and until such time as it is depressed once again, the openings 90 will have been sealed by the engagement of the conical surface 72 of the diaphragm 52 and the conical surface 92 of the plunger 74. When the deflection of the diaphragm 52 has stopped, the check valve 36 will be seated against the valve seat 34 to trap the liquid to be dispensed in the chamber 76. The above pumping cycle need only be repeated for further dispensing of the liquid. In regard to operation of the pump, reference is made to U.S. Pat. No. 3,452,905.

As will be appreciated by those skilled in the art, the trigger assembly of this invention could be applied to pressure containers such as aerosol-type or gas propelled dispensing units.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A dispensing pump for use and incorporation on a container for material to be dispensed comprising in combination:

a relatively rigid base member adapted to be supported across the opening of a container;

said member having an opening and means for communicating said opening with the material to be dispensed;

first valve means for closing the opening during the dispensing of said material and unseating to provide communication between the opening and the material to be dispensed in the container;

a relatively movable member movable relative to the rigid base having peripheral portions thereof in fluid tight engagement with associated portions of the base member;

said movable member including a central boss defining a central opening;

a reciprocal plunger extending into the central opening of the movable member;

said plunger having surfaces cooperable with associated surfaces of the boss in providing means for attaching the plunger to the movable member for permitting movement of the movable member upon reciprocation of the plunger;

the plunger having an interior passage for the dispensing of the material to be dispensed;

the plunger and the base member and the movable member cooperating with one another in defining a pump chamber for containing the material to be dispensed;

the plunger having an opening communicating with the plunger passage and adapted to communicate with the pump chamber for permitting flow of the material from the pump chamber into the plunger passage;

surfaces of the plunger adjacent the plunger opening and associated surfaces of the boss defining a second valve means for sealing the plunger opening during filling of the pump chamber and for opening the plunger opening during dispensing of the material to be dispensed from the pump chamber into the plunger passage;

air network means for permitting the passage of air from the ambient into the container to replenish the volume of the material to be dispensed which is drawn from the container interior into the pump chamber;

the movable member when moved by the plunger in one direction, for pumping, towards the base member being adapted to reduce the volume of the pump chamber thereby pressurizing the material to be dispensed in the pump chamber and, at the same time, causing the second valve means to open the plunger opening whereupon material in the pump chamber is adapted to flow into the plunger passage and be dispensed therefrom;

the movable member when moved in the opposite direction away from the base member upon retraction of the plunger increasing the volume of the pump chamber and closing the plunger opening by the second valve means and causing the unseating of the first valve means to open the base member opening to the material to be dispensed in the container thereby permitting the material to be dispensed in the container to enter the pump chamber with the first valve means closing the base member opening upon termination of the retraction of the plunger and movement of the movable member away from the base member as well as during pumping and dispensing of the material to be dispensed; and trigger means having a main body portion and gripping actuating portion mounted on the plunger and adapted to be finger actuated from a starting position to an actuated position during which the plunger moves the movable member for pumping and then released to the starting position to permit the material to be dispensed to enter the pump chamber, coupling means including a fixed portion extending upwardly from the base member and a movable portion coupled for movement with the plunger for cooperating in defining a recess, the movable portion including a discharge orifice in fluid communication with the plunger for directing material to be dispensed in a predetermined discharge direction, the coupling means coupling the body portion in the recess with the plunger at the side of the movable portion and for permitting the trigger to be pivotally mounted about an axis normal to the discharge direction, and upon manual digital movement of the gripping portion, the body portion will pivot and reciprocate the plunger and thereby facilitate the dispensing of the material from the pump chamber.

2. The invention in accordance with claim 1 wherein surfaces of the trigger means and movable portion define the coupling means and permit the trigger means to be removable and reversible in order that it may be actuated by either the thumb or forefinger.

3. A dispensing pump for use and incorporation on a container for material to be dispensed comprising in combination:

a relatively rigid base member adapted to be supported across the opening of a container;

said member having an opening and means for communicating said opening with the material to be dispensed;

first valve means for closing the opening during the dispensing of said material and unseating to provide communication between the opening and the material to be dispensed in the container;

a relatively movable member movable relative to the rigid base having peripheral portions thereof in fluid tight engagement with associated portions of the base member;

said movable member including a central boss defining a central opening;

a reciprocal plunger extending into the central opening of the movable member;

said plunger having surfaces cooperable with associated surfaces of the boss in providing means for attaching the plunger to the movable member for permitting movement of the movable member upon reciprocation of the plunger;

the plunger having an interior passage for the dispensing of the material to be dispensed;

the plunger and the base member and the movable member cooperating with one another in defining a pump chamber for containing the material to be dispensed;

the plunger having an opening communicating with the plunger passage and adapted to communicate with the pump chamber for permitting flow of the material from the pump chamber into the plunger passage;

surfaces of the plunger adjacent the plunger opening and associated surfaces of the boss defining a second valve means for sealing the plunger opening during filling of the pump chamber and for opening the plunger opening during dispensing of the material to be dispensed from the pump chamber into the plunger passage;

air network means for permitting the passage of air from the ambient into the container to replenish the volume of the material to be dispensed which is drawn from the container interior into the pump chamber;

the movable member when moved by the plunger in one direction, for pumping, towards the base member being adapted to reduce the volume of the pump chamber thereby pressurizing the material to be dispenssed in the pump chamber and, at the same time, causing the second valve means to open the plunger opening whereupon material in the pump chamber is adapted to flow into the plunger passage and be dispensed therefrom;

the movable member when moved in the opposite direction away from the base member upon retraction of the plunger increasing the volume of the pump chamber and closing the plunger opening by the second valve means and causing the unseating of the first valve means to open the base member opening to the material to be dispensed in the container thereby permitting the material to be dispensed in the container to enter the pump chamber with the first valve means closing the base member opening upon termination of the retraction of the plunger and movement of the movable member away from the base member as well as during pumping and dispensing of the material to be dispensed; and trigger means having a main body portion and gripping actuating portion mounted on the plunger and adapted to be finger actuated from a starting position to an actuated position, during which the plunger moves the movable member for pumping, and then released to the starting position to permit the material to be dispensed to enter the pump chamber, coupling means for transmitting movement of the trigger means to the plunger and for permitting the trigger means to be removable and reversible in order that it may be actuated by either the thumb or forefinger, a base portion fixed to the pump, a head portion mounted on the upper end of the plunger, the head portion including a discharge orifice in fluid communication with the interior passage of the plunger, a pair of opposing side walls extending upwardly from the base portion and each terminating in an inwardly extending flange, the head portion and inner surfaces of the side walls forming channels open at both ends to receive the trigger means therein, releasable retention means in the surfaces forming the channels to engage with and releasably retain indexing portions of the trigger means to maintain the trigger means in position when extending within the channels, the trigger means being extendible and removable from either end of the channels with the main body portion housed within the channels and the gripping actuating portion remaining outside of the channels so that when the gripping actuating portion is depressed the main body portion within the channels will depress the plunger and when the gripping actuating portion is released the trigger will permit the plunger to return to its initial position.

4. The invention in accordance with claim 3, wherein the head portion is in the form of a rectangularly shaped block terminating in a laterally projecting nose with a right angle passage therethrough the shorter leg of which is in communication with the passage in the plunger and the longer leg of which terminating in the orifice at the projecting nose, the base portion being substantially horizontal and the opposing side walls being rectangular in configuration with each side wall having a pair of spaced notches on the underside of the inwardly extending flange thereof, the trigger means including a pair of spaced parallel substantially rectangularly shaped body prongs with both body prongs being integrally formed with an arcuately shaped gripping portion, an arcuate recess on the underside of each prong adjacent the location of the gripping portion and positioned so as to permit a pivotal action of the trigger means with respect to the plunger when mounted thereon, a pair of spaced shoulders extending upwardly from the upper surface of each prong and positioned so as to mate with the notches in the underside of the flange of each side wall by snapping into position and also being able to be resiliently snapped out of position and permit extension of the trigger prongs into the channels from the other side thereof, so that when the trigger means is indexed in position by means of the engagement between the shoulders and the notches the gripping portion can be depressed so as to pivot the trigger means and push the plunger downward to actuate the dispensing pump and when the gripping portion is released the trigger means will pivot upward permitting the plunger to return to the initial configuration.

5. The invention in accordance with claim 3, wherein a biasing spring means biases the plunger upward until stop means retains the plunger in an upper position.

6. A reversible trigger for a dispensing pump of the type employing a reciprocal plunger having a passage therethrough a substantially horizontal base fixed to the pump and having two opposing side walls extending upwardly therefrom, a nozzle body coupled to the plunger, said nozzle body mounted between the upstanding walls and forming with the the opposing side walls two opposing channels open at both ends and including releasable trigger receiving and mounting means therein, the trigger comprising; a body portion of two opposing substantially parallel spaced prongs with each prong having a free end and having its other end integrally formed with an actuating gripping portion, the prongs including indexing and releasable mounting means for interengagement with surfaces in the channels formed on each side of the nozzle body so that the prongs can be simultaneously inserted from either open end of the channels into a removably mounted position on the plunger, the gripping actuating portion being positioned so as to extend outside of the channels and means on the trigger and nozzle body to permit pivotal movement of the trigger so as to actuate the plunger in a corresponding reciprocal movement as the trigger is pivoted.

7. The invention in accordance with claim 6 wherein each of the opposing upstanding side walls terminate in an inwardly extending flange, a pair of spaced notches on the undersurface of each flange, the prongs on the trigger being substantially rectangular in configuration and having a pair of spaced shoulders on the upper surface thereof for engagement with the notches on the undersurface of the flange of a side wall, the prongs being adapted to be snapped into position within the channels with the shoulders releasably engaged within the notches, the prongs being insertable and removable from either open end of the channels, the gripping portion extending arcuately downward and away from the prongs and the portion of the prongs adjacent to the gripping portion including an arcuate recess to facilitate pivoting of the trigger with respect to the plunger as the gripping portion is depressed and released causing simultaneous reciprocal movement of the plunger.

8. The invention in accordance with claim 6, wherein the nozzle body is substantially rectangular in configuration so as to extend between the prongs of the trigger when the trigger is mounted on the plunger and the nozzle body terminating in a laterally extending nose having an orifice at the end thereof for transmittal of the dispensed fluid therethrough, the orifice communicating with a right angle passage through the nozzle body which is in communication with the passage through the plunger to permit passage of dispensed fluid therethrough.

9. A trigger actuating mechanism for a reciprocal plunger dispensing pump and for association with a cap having a stationary wall for cooperating in mounting the pump on the neck of a container, and a movable part coupled with the plunger for movement therewith, the movable part including a discharge orifice means directing the container contents from the pump in a predetermined discharge direction, the mechanism including a fixed bracket means extending from the cap and cooperating with surfaces of the movable part in defining a variable size trigger accommodating recess means between side walls of the movable part and bracket means for receiving a trigger for reciprocation of the plunger, a trigger having a finger engaging actuator and prong means extending therefrom for disposal in the recess means between the bracket means and movable part, the recess means and prong means extending in a direction parallel to the predetermined discharge direction, coupling means coupling the prong means to the plunger and said movable part serving as a coupling means for coupling the prong means to the plunger so that when the actuator is manually moved the prong means engages with surfaces of the bracket means and movable part to cause the recess means to increase in size and to cause reciprocation of the plunger from its initial extended position to its depressed position and consequent pumping of the container contents by the pump and when the actuator is released the recess means decreases in size and the plunger is permitted to return to the initial position and the pumping action ceases.

10. A trigger actuating mechanism for a reciprocal plunger dispensing pump and for association with a cap having a stationary wall for cooperating in mounting the pump on the neck of a container, and a nozzle coupled with the plunger for directing the container contents from the pump, the mechanism including bracket means extending from the cap and cooperating with the nozzle in defining a trigger accommodating recess means between side walls of the nozzle and bracket means for receiving a trigger for reciprocation of the plunger, a trigger having a finger engaging actuator and prong means extending therefrom for disposal in the recess means, coupling means coupling the prong means to the plunger and when the actuator is manually moved the prong means engages with surfaces of the bracket means and coupling means to cause reciprocation of the plunger from its initial extended position to its depressed position and consequent pumping of the container contents by the pump and when the actuator is released the plunger is permitted to return to the initial position and the pumping action ceases, the recess means being continuous having two open ends and the prong means being insertable into the recess means from either end to permit the actuator to be oriented in a predetermined position with respect to the coupling means and permit the trigger mechanism to be actuated by the forefinger when the prong means is inserted into the recess means from one end and the thumb when inserted from the other end.

11. The invention in accordance with claim 10 wherein latch means are defined by engaging surfaces defining the prong means and recess means for releasably latching the prong means in said recess means.

12. A trigger facilitating the dispensing of contents of a container having a reciprocal stem carrying a nozzle, the stem having a passage for communicating the nozzle with the interior of the container, the container including a substantially horizontal base having two opposed side walls extending upwardly therefrom and a nozzle body mounted between the upstanding walls forming with the opposed side walls channels, the channels opening at least at one end and including trigger mounting means therein, the trigger comprising; a body portion of two opposing substantially parallel spaced prongs with each end having a free end and having its other end integrally formed with an actuating gripping portion, the prongs including means for interengagement with surfaces in the channels, the gripping actuating portion being positioned so as to extend outside of the channel and pivotal means to permit pivotal movement of the trigger so as to actuate the stem in a corresponding reciprocal movement as the trigger is pivoted.

13. The invention in accordance with claim 12, wherein in each of the opposing upstanding side walls terminate in an inwardly extending flange, a pair of spaced notches on the undersurface of each flange, the prongs on the trigger being substantially rectangular in configuration and having a pair of spaced shoulders on the upper surface thereof for engagement with the notches on the undersurface of the flange of a side wall, the prongs being adapted to be snapped into position within the channels with the shoulders releasably engaged within the notches, the gripping portion extending arcuately downward and away from the prong and the portion of the prong adjacent to the gripping portion including an arcuate recess to faciliate pivoting of the trigger with respect to the stem as the gripping portion is depressed and released causing simultaneous reciprocal movement of the stem.

14. The invention in accordance with claim 12, wherein the nozzle is substantially rectangular in configuration so as to extend between the prongs of the trigger when the trigger is mounted on the stem and the nozzle terminating in a laterally extending nose having an orifice at the end thereof for transmittal of the dispensed fluid therethrough, the orifice communicating with a right angle passage through the nozzle which is in communication with the passage through the stem to permit passage of dispensed fluid therethrough.

15. A trigger actuating mechanism for a dispenser and for association with a cap having a stationary wall for cooperating in mounting the dispenser on the neck of a container, a stem forming part of the dispenser, and a movable part coupled to the stem for movement therewith, the movable part including a discharge orifice means for directing the container contents from the dispenser in a predetermined discharge direction, the trigger actuating mechanism including fixed bracket means extending from the cap and cooperating with the movable part in defining a trigger accommodating variable size recess means between side walls of the movable part and bracket means for receiving a trigger for reciprocation of the plunger, the recess means extending in a direction parallel to the predetermined discharge direction, a trigger having a finger engaging actuator and prong means extending therefrom for disposal in the recess means, the prong means extending parallel to the predetermined discharge direction when disposed in the recess means, and said movable part serving as a coupling means for coupling the prong means to the stem so that when the actuator is manually moved the prong means engages with surfaces of the bracket means and coupling means to cause the recess means to increase in size and to cause reciprocation of the stem from its initial extended position to its depressed position to facilitate the dispensing of the container contents by the dispenser and when the actuator is released the recess means decreases in size and the stem is permitted to return to its initial position and the dispensing action ceases.

16. A trigger actuating mechanism for a dispenser and for association with a cap having a stationary wall for cooperating in mounting the dispenser on the neck of a container, a stem forming part of the dispenser and a nozzle coupled with the stem for movement therewith and for directing the container contents from the dispenser, the trigger actuating mechanism including bracket means extending from the cap and cooperating with the nozzle in defining a trigger accommodating recess means between sidewalls of the nozzle and bracket means for receiving a trigger for reciprocation of the stem, a trigger having a finger engaging actuator and prong means extending therefrom for disposal in the recess means, the prong means being pivotally mounted in the recess means so that when the actuator is manually moved the prong means engages with surfaces of the bracket means and the nozzle to cause reciprocation of the stem from an initial extended position to a depressed position to facilitate the dispensing of the container contents by the dispenser and when the actuator is released the stem is permitted to return to its initial position and the dispensing action ceases, the recess means being continuous having two open ends, and the prong means being insertable into the recess means from either end to permit the actuator to be oriented in a predetermined position with respect to the bracket means and nozzle and permit the trigger mechanism to be actuated by the forefinger when the prong means is inserted into the recess means from one end and the thumb when inserted from the other end.

* * * * *